US009537278B2

(12) United States Patent
Kawagishi et al.

(10) Patent No.: US 9,537,278 B2
(45) Date of Patent: Jan. 3, 2017

(54) TERMINAL GROUP AND CONNECTOR

(71) Applicant: Yazaki Corporation, Minato-ku, Tokyo (JP)

(72) Inventors: Mika Kawagishi, Makinohara (JP); Kouichi Ohyama, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/017,842

(22) Filed: Feb. 8, 2016

(65) Prior Publication Data

US 2016/0233603 A1 Aug. 11, 2016

(30) Foreign Application Priority Data

Feb. 9, 2015 (JP) ..... 2015-023335
May 20, 2015 (JP) ..... 2015-102970

(51) Int. Cl.

| | |
|---|---|
| ***H01R 43/22*** | (2006.01) |
| ***H01R 13/422*** | (2006.01) |
| ***H01R 13/41*** | (2006.01) |
| *H01R 12/58* | (2011.01) |
| *H01R 12/72* | (2011.01) |

(52) U.S. Cl.

CPC ..... *H01R 43/22* (2013.01); *H01R 13/41* (2013.01); *H01R 13/422* (2013.01); *H01R 12/58* (2013.01); *H01R 12/724* (2013.01)

(58) Field of Classification Search

CPC ..... H01R 13/422; Y10S 439/9241; Y10S 439/9242

See application file for complete search history.

(56) References Cited

U.S. PATENT DOCUMENTS 3,380,141 A * 4/1968 Rofer ..... H01R 43/22 29/278
3,432,795 A * 3/1969 Jayne ..... H01R 13/631 439/60
T101,002 I4 * 9/1981 Ellington, III ..... H01R 43/22 29/747
5,362,256 A * 11/1994 Hashiguchi ..... H01R 13/28 439/660
5,667,401 A * 9/1997 Kuwabara ..... H01R 12/716 439/405
5,945,727 A * 8/1999 Ishiwa ..... H01R 13/41 257/666

(Continued)

FOREIGN PATENT DOCUMENTS

JP 2011-198594 A 10/2011

*Primary Examiner* — James Harvey
(74) *Attorney, Agent, or Firm* — Sughrue Mion, PLLC

(57) ABSTRACT

A terminal group includes: a plurality of pin terminals, each pin terminal being formed of a metal wire of a predetermined length and being to be press-fitted and held in each of a plurality of terminal insertion holes of a connector housing. Some of the plurality of pin terminals have different overall lengths. The plurality of pin terminals respectively have a pair of press-fitting supports that protrude from both side edges of each of the plurality of pin terminals in a width direction at the same distant positions from a distal end in an insertion direction, and insertion direction rear end side surfaces of the press-fitting supports receive reaction force with respect to the terminal insertion holes in press-fitting.

8 Claims, 13 Drawing Sheets

(56) References Cited

U.S. PATENT DOCUMENTS

| | | | | | |
|---|---|---|---|---|---|
| 6,048,232 | A * | 4/2000 | Chen | H01R 13/422 | 439/733.1 |
| 6,152,782 | A * | 11/2000 | Volkert | H01R 13/41 | 439/733.1 |
| 6,328,576 | B1 * | 12/2001 | Takahashi | H01R 13/41 | 439/733.1 |
| 6,447,340 | B1 * | 9/2002 | Wu | H01R 12/716 | 439/660 |
| 7,175,480 | B2 * | 2/2007 | Yamashita | H01R 13/41 | 439/733.1 |
| 7,448,918 | B2 * | 11/2008 | Lappoehn | H01R 13/41 | 439/660 |
| 7,708,605 | B2 * | 5/2010 | Shibata | H01R 13/41 | 439/733.1 |
| 2002/0040520 | A1 * | 4/2002 | Suzuki | H01R 43/22 | 29/758 |
| 2005/0277312 | A1 * | 12/2005 | Nakamura | H01R 13/41 | 439/82 |
| 2011/0244708 | A1 * | 10/2011 | Hayashi | H01R 4/4836 | 439/370 |
| 2012/0164851 | A1 * | 6/2012 | Shindo | H01R 12/724 | 439/55 |
| 2016/0020544 | A1 * | 1/2016 | Ohyama | H01R 13/41 | 439/751 |
| 2016/0233603 | A1 * | 8/2016 | Kawagishi | H01R 13/422 | |

* cited by examiner

Prior Art

Prior Art

Prior Art

TERMINAL GROUP AND CONNECTOR

CROSS REFERENCE TO RELATED APPLICATION

This application is based on Japanese Patent Application (No. 2015-023335) filed on Feb. 9, 2015, and Japanese Patent Application (No. 2015-102970) filed on May 20, 2015, the contents of which are incorporated herein by reference. Also, all the references cited herein are incorporated as a whole.

BACKGROUND OF THE INVENTION

Technical Field

One or more embodiments of the invention relate to a terminal group and a connector.

In the related art, a board connector 501 as illustrated in FIG. 11 is used as a board connector for wire connection with a circuit board. The board connector 501 includes a synthetic resin connector housing 503 formed to have substantially a rectangular parallelepiped shape, as a whole, and a plurality of board terminals 505 provided to protrude from the connector housing 503. Also, the board terminal 505 is formed to have an L shape with both a base end portion 507 provided to horizontally protrude from the connector housing 503 and an upright portion 509 provided to protrude downward from a distal end portion of the base end portion 507. A distal end of the upright portion 509 is inserted and soldered into a through-hole of the circuit board (not illustrated) and a terminal of a counterpart connector (not illustrated) is connected to the base end portion 507.

Incidentally, in order to realize reliable and stable connection between the board terminals and external connection terminals, the respective board terminals press-fitted in terminal holding holes of a terminal holding tool (connector housing) required to be tightly fixed and held to the terminal holding tool at a position. Therefore, as illustrated in FIG. 12, Patent Document 1 discloses a board terminal 511 that is formed of a metal wire with a sectional shape which is similar to or slightly greater in size than a terminal holding hole 515 of a terminal holding tool 513 and the metal wire is cut by a predetermined length. In addition, press-forging is performed to a press-fitted section 517 to the terminal holding hole 515 in a direction perpendicular to the axis such that a protrusion 519 protruding outward on both sides in the direction perpendicular to the axis, which is orthogonal to a press-forging direction, is provided.

As illustrated in FIG. 13, a portion of the board terminal 511 on one end side in an axial direction (length direction), that is, the front end side in a press-fitting direction of the terminal holding hole 515 becomes a board connecting portion 521. In addition, a portion of the board terminal 511 on the other end side, that is, the rear end side in a press-fitting direction of the terminal holding hole 515 becomes a connector connecting portion 523.

Patent Document 1 is JP-A-2011-198594.

SUMMARY OF THE INVENTION

However, when the board terminal 505 or the board terminal 511 illustrated in FIG. 11 and FIG. 13 is inserted into the terminal insertion hole 525 or a terminal holding hole 515 of a housing, the rear end portion of the board terminal 505 or the board terminal 511 is pressed and inserted, which may result in a problem in that deformation or scratching is likely to occur at the rear end portion of the terminal. Further, the board terminal 511 has an abutting-contact protrusion 527 on the rear side of the press-fitted section 517 in the insertion direction; however, the abutting-contact protrusion 527 is for locking to a locking surface 529 of the terminal holding tool 513 to regulate a press-fitted position of the board terminal 511 in the axial direction (refer to FIG. 12).

In addition, a plurality of board terminals 505 or board terminals 511 generally as a multipolar terminal group are inserted by a dedicated head of an automatic machine (terminal press-fitting apparatus) when the terminals are inserted into the housing. The terminal press-fitting apparatus needs the board terminal 505 or the board terminal 511 which have different lengths in a case where the multipolar board terminals 505 or board terminals 511 are inserted. Accordingly, since the terminal press-fitting apparatus needs to respond to different insertion strokes, a plurality of dedicated heads are needed so as to correspond to the board terminals 505 or the board terminals 511 which have different lengths. Accordingly, a mechanism becomes complicated and it is difficult to miniaturize the apparatus.

One or more embodiments of the present invention are made in consideration of the above circumstances and an object thereof is to provide a terminal group and a connector with which a rear end portion of a terminal is not deformed such that a terminal press-fitting apparatus can be miniaturized and manufacturing costs thereof can be reduced.

The above object according to the embodiments is achieved by employing the following configurations.

(1) There is provided a terminal group including: a plurality of pin terminals, each pin terminal being formed of a metal wire of a predetermined length and being to be press-fitted and held in each of a plurality of terminal insertion holes of a connector housing, wherein some of the plurality of pin terminals have different overall lengths, the plurality of pin terminals respectively have a pair of press-fitting supports that protrude from both side edges of each of the plurality of pin terminals in a width direction at the same distant positions from a distal end in an insertion direction, and insertion direction rear end side surfaces of the press-fitting supports receive reaction force with respect to the terminal insertion holes in press-fitting.

According to the terminal group having the configuration according to (1), when the plurality of pin terminals of the terminal group are press-fitted in the plurality of terminal insertion holes of the connector housing, respectively, the insertion direction rear end side surfaces of the press-fitting supports, which are formed at the same positions distant from the distal ends of the pin terminals in the insertion direction regardless of the different overall lengths of the plurality of pin terminals, are supported by an insertion jig or the like, and thus, it is possible to always receive reaction force of the press-fitting of the pin terminals which are press-fitted in the terminal insertion holes of the connector housing. Therefore, the pin terminals having different lengths can be continuously inserted into the plurality of terminal insertion holes of the connector housing, with the same stroke. As a result, it is possible to reduce the terminal press-fitting apparatus in size and it is possible to reduce manufacturing costs of a connector.

(2) In the terminal group according to (1), at least a pair of press-fitted sections may be formed on a front end side of the pin terminal than the press-fitting supports in the insertion direction so as to protrude from both side edges of the pin terminal in the width direction and the pair of press-fitted sections may be press-fitted and held in the terminal insertion hole.

According to the terminal group having the configuration according to (2), since the pair of press-fitted sections protruding from both the side edges of the pin terminal in the width direction are press-fitted and held in the terminal insertion hole, it is easy to achieve high press-fitting accuracy and strong press-fitting and holding force, compared to a case where a pin terminal is inserted into a terminal insertion hole without the press-fitted section.

(3) In the terminal group according to (2), a plurality of pairs of press-fitted sections are formed on the pin terminal in the insertion direction and are formed to have protruding heights which are lowered, respectively, as close to a distal end of the pin terminal in the insertion direction.

According to the terminal group having the configuration according to (3), a press-contact force with respect to the terminal insertion hole is increased in a stepwise manner as deep in an insertion depth of the distal end of the pin terminal in the insertion direction, which is inserted into the terminal insertion hole, and the plurality of pairs of press-fitted sections are press-fitted while inner surfaces of the terminal insertion hole are gradually deformed. Therefore, it is possible to reduce press-fitting resistance.

(4) In the terminal group according to (2) or (3), a non-plastic forming-processed surface where plastic forming is not performed on a terminal surface of the pin terminal is provided, in at least one of a region or a part of the region between the pair of the press-fitting supports and a region or apart of the region between the pair of press-fitted sections.

According to the terminal group having the configuration according to (4), the non-plastic forming-processed surface where plastic forming is not performed on the terminal surface remains in at least one of a region or a part of the region between the pair of press-fitting supports and a region or a part of the region between the pair of press-fitted sections. On the pin terminal, the non-plastic forming-processed surface is provided in the vicinity of the press-fitted sections, and thereby degradation of strength due to the formed press-fitted sections is suppressed. In this manner, the terminal is prevented from being deformed when the pin terminal is inserted. In addition, in the pin terminal, the non-plastic forming-processed surface is provided in the vicinity of the press-fitting supports, and thereby degradation of strength due to the formed press-fitting supports is suppressed. In this manner, the pin terminal is prevented from being deformed or broken, when the press-fitting supports are pressed during the press-fitting.

(5) In the terminal group according to (4), the non-plastic forming-processed surface is connected to the terminal surface by a tapered flat surface having a width which is gradually widened.

According to the terminal group having the configuration according to (5), the non-plastic forming-processed surface of the pin terminal is connected to the terminal surface by a tapered flat surface having a width which is gradually widened. The non-plastic forming-processed surface is not connected to the terminal surface by a corner having a right angle. In this manner, stress concentration is unlikely to occur in the pin terminal, compared to a shape having a corner, and thus a higher strength against deformation of the terminal during the insertion is achieved.

(6) In the terminal group according to any one of (2) to (5), the pin terminal has a plurality of the pairs of press-fitted sections which are formed at intervals in the insertion direction. The plurality of the pairs of press-fitted sections are provided at different positions from each other in a height direction orthogonal to the width direction of the pin terminal.

According to the terminal group having the configuration according to (6), when the pin terminal is inserted into the terminal insertion hole of the connector housing, the press-fitted sections on the front side in the insertion direction are, first, press-fitted. When the press-fitted sections of the pin terminal on the rear side are press-fitted, the press-fitted sections on the rear side are press-fitted at positions different from the positions of the press-fitted sections on the front side in the height direction. Accordingly, press-fitting portions of the terminal insertion hole, in which the press-fitted sections of the pin terminal on the rear side are press-fitted, is not worn by the press-fitted sections thereof on the front side. Therefore, the pin terminal has a strong holding force obtained while the press-fitting of the press-fitted sections thereof on the front side does not influence the holding force of the press-fitted sections thereof on the rear side.

(7) In the terminal group according to any one of (1) to (6), the pin terminal is formed of the metal wire on which plating is performed in advance.

According to the terminal group having the configuration according to (7), the metal wire made of an elongated conductive metal material, on which plating is performed in advance, is cut by the predetermined length such that the pin terminal is formed. Therefore, it is possible to achieve improvement in yield, compared to a case of using the pin terminal formed through press-working. In addition, a broken surface, on which plating is not performed, is not formed, which can ensure good corrosion resistance and good connection reliability with a counterpart terminal without performing complicated re-plating or chamfering and can ensure high quality.

Moreover, the pin terminal made of the metal wire, on which plating is performed in advance, does not have an undercut or a burr, and the plating is evenly performed over the entire circumference. Therefore, in a case where the terminal insertion hole of the connector housing is sealed using a sealing material, it is possible to obtain uniform adhesiveness of the sealing material on the periphery of the pin terminal, which can ensure good sealability.

(8) There is provided a connector including: a connector housing having a plurality of terminal insertion holes; and a terminal group of a plurality of pin terminals which are press-fitted and held in the plurality of terminal insertion holes, respectively. The plurality of pin terminals, which include the pin terminals having different overall lengths, have a pair of press-fitting supports that protrude from both side edges of the pin terminal in a width direction thereof, respectively, at the same positions from the distal end in an insertion direction and that receive reaction force with respect to the terminal insertion holes in press-fitting.

According to the connector having the configuration according to (8), when the plurality of pin terminals of the terminal group are press-fitted in the plurality of terminal insertion holes of the connector housing, respectively, the insertion direction rear end side surfaces of the press-fitting supports, which are formed at the same positions from the distal ends of the pin terminals in the insertion direction regardless of the different overall lengths of the plurality of pin terminals, are supported by an insertion jig or the like, and thus, it is possible to always receive reaction force of the press-fitting of the pin terminals which are press-fitted in the terminal insertion holes of the connector housing. Therefore, the pin terminals having different lengths can be continuously inserted into the plurality of terminal insertion holes of the connector housing, with the same stroke. As a result, it is possible to reduce the terminal press-fitting apparatus in size and it is possible to reduce manufacturing costs of a connector.

By using a terminal group and a connector according to the embodiments of the present invention, a terminal press-fitting apparatus can be miniaturized and manufacturing costs of the connector can be reduced such that a connector can be provided at a low cost.

As above, the embodiments of the present invention are briefly described. Further, the present invention will be clear in detail by reading through one or more modes for carrying out the invention (hereinafter, referred to as an "embodiment") with reference to the drawings.

DETAILED DESCRIPTION OF THE EXEMPLARY EMBODIMENTS

Figure 1:
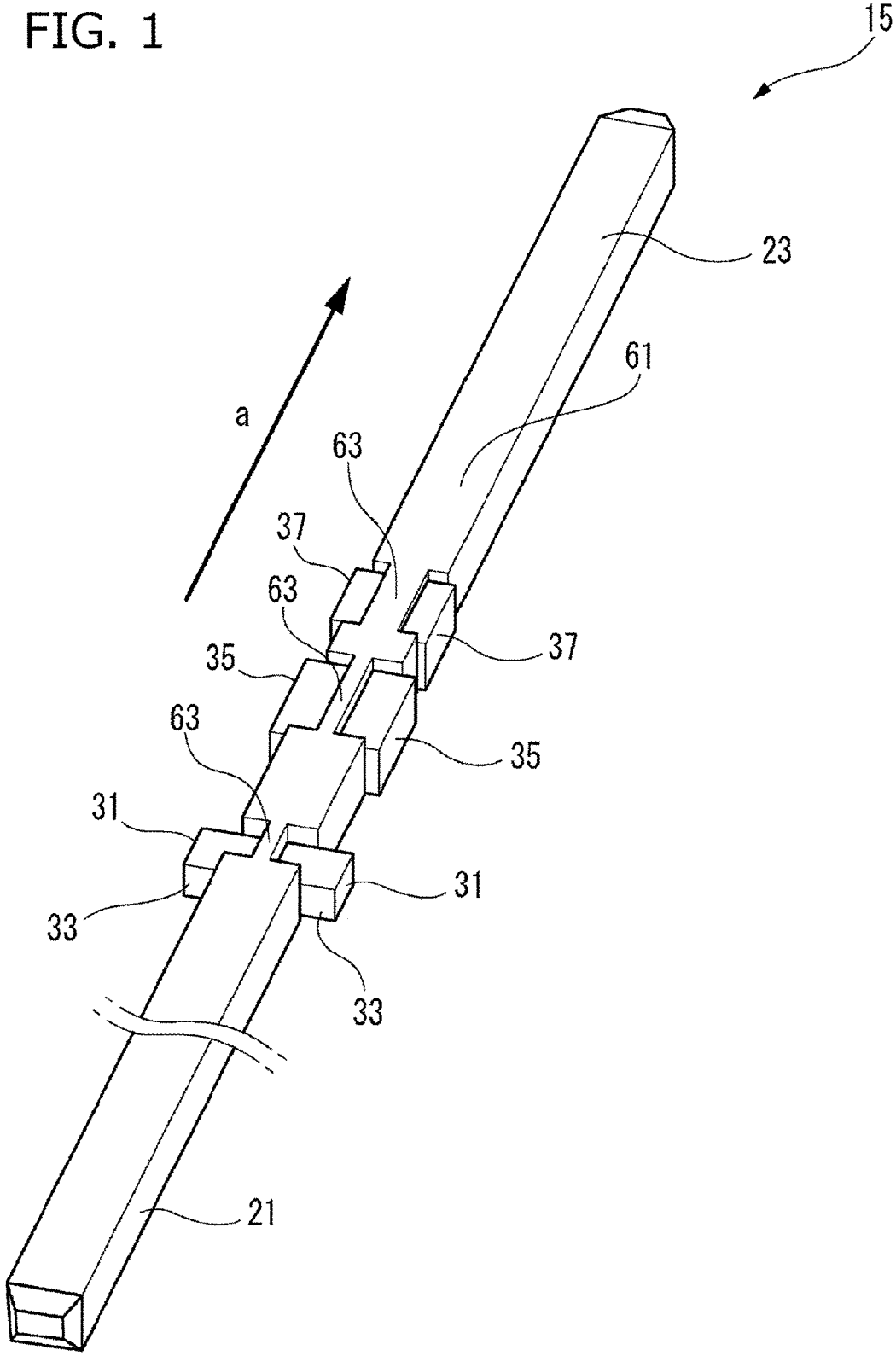
FIG. 1 is a partial perspective view of a pin terminal according to an embodiment of the present invention.

Hereinafter, an embodiment of the present invention will be described with reference to the drawings.

A terminal group 11 (refer to FIGS. 5 and 6) of a plurality of pin terminals 15 according to an embodiment of the present invention is applied to a board connector 13 (refer to FIG. 6) which is a connector. The board connector 13 is installed on a printed circuit board (not illustrated) in which, for example, an electrical junction box of an automobile is accommodated. The terminal group 11 consists of the plurality of pin terminals 15. The pin terminals 15 are formed by cutting an elongated conductive metal wire by a predetermined length and are press-fitted and held in a plurality of terminal insertion holes 19 of a connector housing 17 (refer to FIG. 6). The pin terminal 15 is bent such that one end side (board connecting portion 21) is formed to an L shape and then is soldered to a conduction path of the printed circuit board (not illustrated), and the other end side (electrical contact section 23) is fitted and connected to a connection terminal of a connector provided at an end of an external electric wire. In this manner, the board connector 13 performs connection of an external electric circuit to the printed circuit board.

Figure 2:
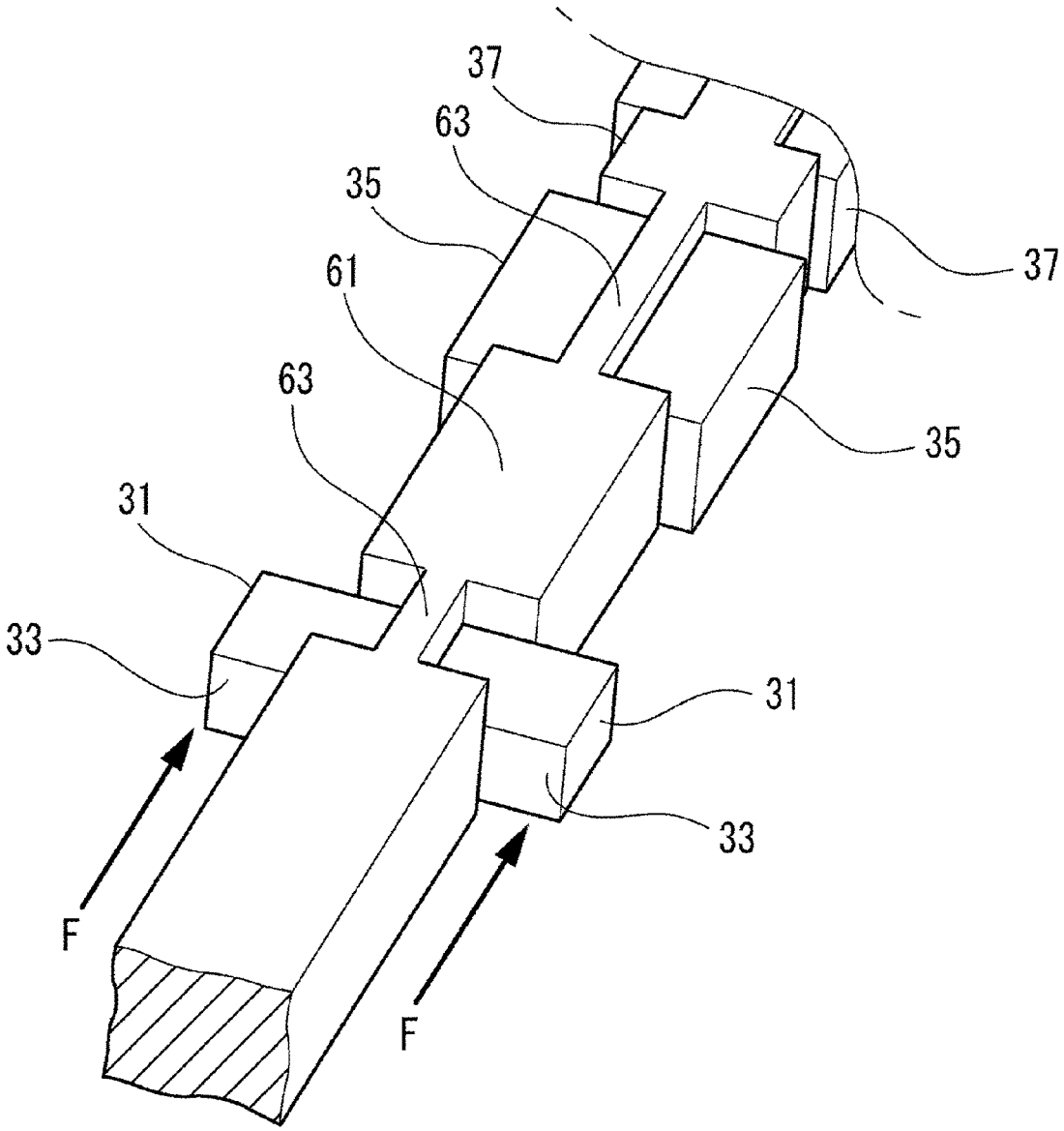
FIG. 2 is an enlarged view of main parts of the pin terminal illustrated in FIG. 1.
Figure 6:
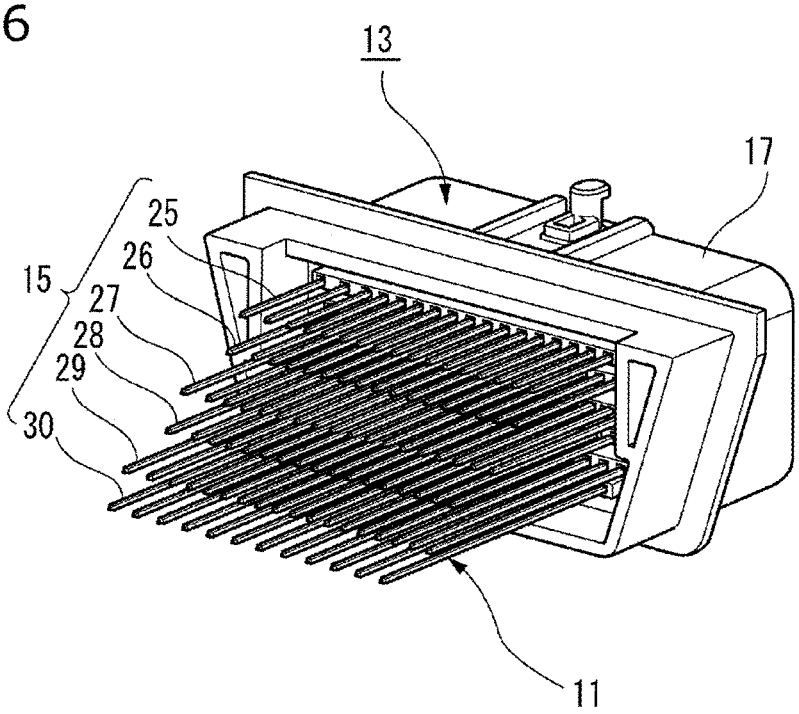
FIG. 6 is a perspective view of an entire connector in which a plurality of pin terminals of the terminal group illustrated in FIG. 5 are press-fitted and held in a plurality of terminal insertion holes of a connector housing.
Figure 7:
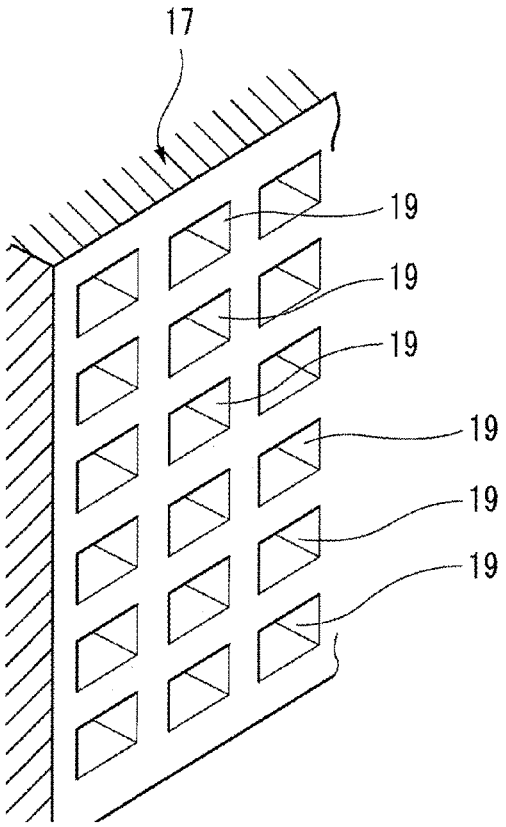
FIG. 7 is a perspective view of main parts illustrating a part of the connector housing in which the terminal insertion holes are provided.

As illustrated in FIGS. 1 to 2B, the pin terminal 15 is formed to have an elongated quadrangular rod shape, as a whole. As illustrated in FIGS. 6 to 7, the plurality of terminal insertion holes 19 are arranged in the connector housing 17 in which the pin terminals 15 are inserted in the longitudinal and horizontal directions. The pin terminals 15 inserted in the terminal insertion holes 19 at each row in the vertical direction of the connector housing 17 have different lengths required to be connected to the printed circuit board. Therefore, as illustrated in FIG. 6, the terminal group 11 includes the plurality of pin terminals 15 having different overall lengths from one another. In a case where six rows of the plurality of terminal insertion holes 19, which are arranged in a row as in the present embodiment, are arranged in the vertical direction, the pin terminals 15 (that is, a pin terminal 25, a pin terminal 26, a pin terminal 27, a pin terminal 28, a pin terminal 29, and a pin terminal 30 illustrated in FIG. 6) having six types of different lengths are included in the terminal group 11.

The plurality of pin terminals 15 including the pin terminals 25, 26, 27, 28, 29, and 30 having different overall lengths each have a pair of press-fitting supports 31 at the same positions from the distal end in the insertion direction. The pair of press-fitting supports 31 protrude from both side edges of the pin terminal 15 in the width direction, respectively. The press-fitting support 31 is formed by press-forging an intermediate portion, in a direction (orthogonal-to-axis direction) orthogonal to a length direction, in the length direction (axial direction). Here, one end side of the pin terminal 15 in the axial direction is pointed in the insertion direction (arrow a direction in FIG. 1). An insertion direction rear end side surface 33 of the press-fitting support 31 receives reaction force during insertion into the terminal insertion hole 19. That is, the insertion direction rear end side surface 33 of the press-fitting support 31 becomes a pressed surface which is pressed by a pressing force F of an insertion head 39 (refer to FIGS. 8A and 8B) at a terminal press-fitting position. In the present embodiment, the press-fitting support 31 is formed to be a rectangle in a plan view; however, the shape thereof is not limited thereto, as long as the insertion direction rear end side surface 33 can receives the reaction force during the insertion.

In addition, each of the pin terminals 15 has a pair of press-fitted sections 35 which are formed on the distal end side from the press-fitting support 31 in the insertion direction. The press-fitted sections 35 are formed to protrude from both side edges of the pin terminal 15 in the width direction, through press-forging or the like, similar to the above description. In the pin terminal 15, the press-fitted sections 35 are press-fitted and held in the terminal insertion hole 19. In the present embodiment, the press-fitted section 35 is formed to be rectangular in the plan view; however, the shape is not limited thereto, as long as insertability is appropriate and removal from the terminal insertion hole 19 is regulated. Although not illustrated, the press-fitted section 35 may have an inclined surface which is gradually lowered toward the distal end side in the insertion direction. The press-fitted section 35 has such a wedge shape such that the insertability is improved, which can ensure the holding properties.

Further, in the present embodiment, in the pin terminal 15, a pair of press-fitted sections 37 are formed on the distal end side from the pair of press-fitted sections 35 in the insertion direction and a plurality of pairs (in an example of the drawing, two pairs) of press-fitted sections 35 and 37 are formed in the insertion direction. The two pairs of press-fitted sections 35 and 37 (refer to FIG. 1) are formed to have protruding heights which are lowered, respectively, as close to the distal end of the pin terminal 15 in the insertion direction. In other words, the pair of press-fitted sections 37 on the front side in the insertion direction have a protruding height lower than that of the following press-fitted sections 35.

The pin terminal 15 has a non-plastic forming-processed surface 63 remaining in at least one of a region or a part of the region between the pair of press-fitting supports, and a region or a part of the region between the pair of press-fitted sections. The non-plastic forming-processed surface 63 is a surface of a terminal surface 61 of the pin terminal 15, on which plastic forming is not performed. In an example in the drawing, the non-plastic forming-processed surfaces 63 are provided between the plurality of pairs (two pairs) of press-fitted sections 35 and 37 and between the pair of press-fitting supports 31. Further, "the part of the region therebetween" means that the non-plastic forming-processed surface 63 may not be provided on the entire region between the press-fitting supports 31 and on the entire region between the press-fitted sections 35 and 37. In other words, in the non-plastic forming-processed surface 63, the region between the press-fitting supports 31 and the part of the region between the press-fitted sections 35 and 37 may not be pressed by being pressed.

In the pin terminal 15 on which the non-plastic forming-processed surface 63 is provided, the non-plastic forming-processed surface 63 is provided in the vicinity of the press-fitted sections 35 and 37, and thereby degradation of strength due to forming the press-fitted sections 35 and 37 is suppressed. In this manner, the terminal is prevented from being deformed when the pin terminal 15 is inserted. In addition, in the pin terminal 15, the non-plastic forming-processed surface 63 is provided in the vicinity of the press-fitting support 31, and thereby degradation of strength due to forming the press-fitting support 31 is suppressed. In this manner, the pin terminal 15 is prevented from being deformed or broken, when the press-fitting support 31 is pressed and the pin terminal 15 is press-fitted.

Figure 3A:
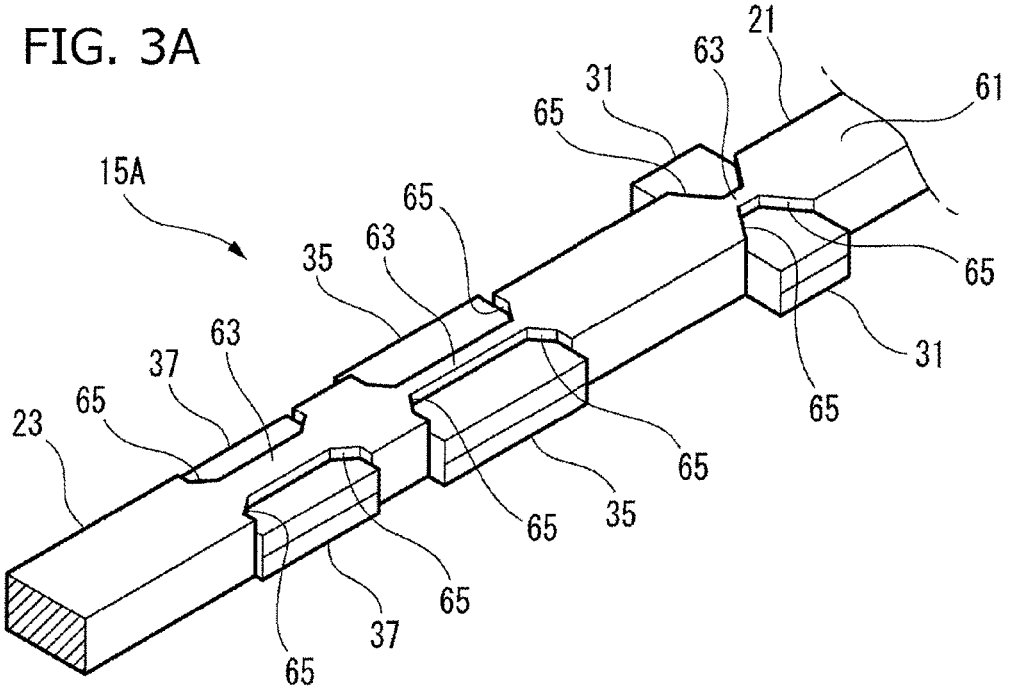
FIG. 3A is an enlarged view of main parts of the pin terminal according to a modification example which has tapered flat surfaces on non-plastic forming-processed surfaces and FIG. 3B is a plan view of FIG. 3A.
Figure 3B:
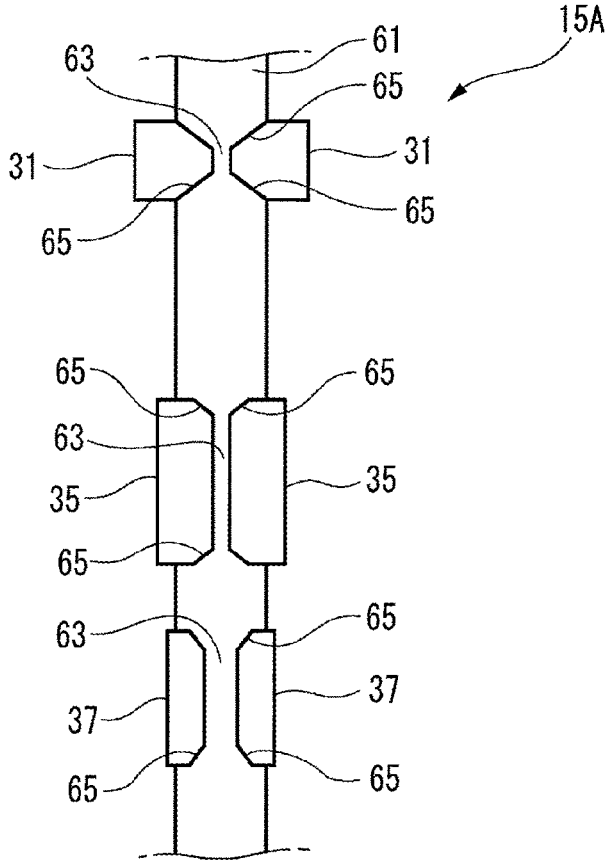

FIG. 3A is an enlarged view of a pin terminal 15A according to a modification example which has a tapered flat surface 65 on the non-plastic forming-processed surface 63 and FIG. 3B is a plan view of FIG. 3A. The non-plastic forming-processed surface 63 illustrated in FIGS. 3A and 3B is connected to the terminal surface 61 by the tapered flat surface 65 having a width which is gradually widened.

In the pin terminal 15A on which the tapered flat surface 65 is provided on the non-plastic forming-processed surface 63, the non-plastic forming-processed surface 63 is not connected to the terminal surface 61 by a corner having a right angle. In this manner, stress concentration is unlikely to occur in the pin terminal 15A, compared to a shape having a corner, and thus a higher strength against deformation of the terminal during the insertion is achieved.

Figure 4A:
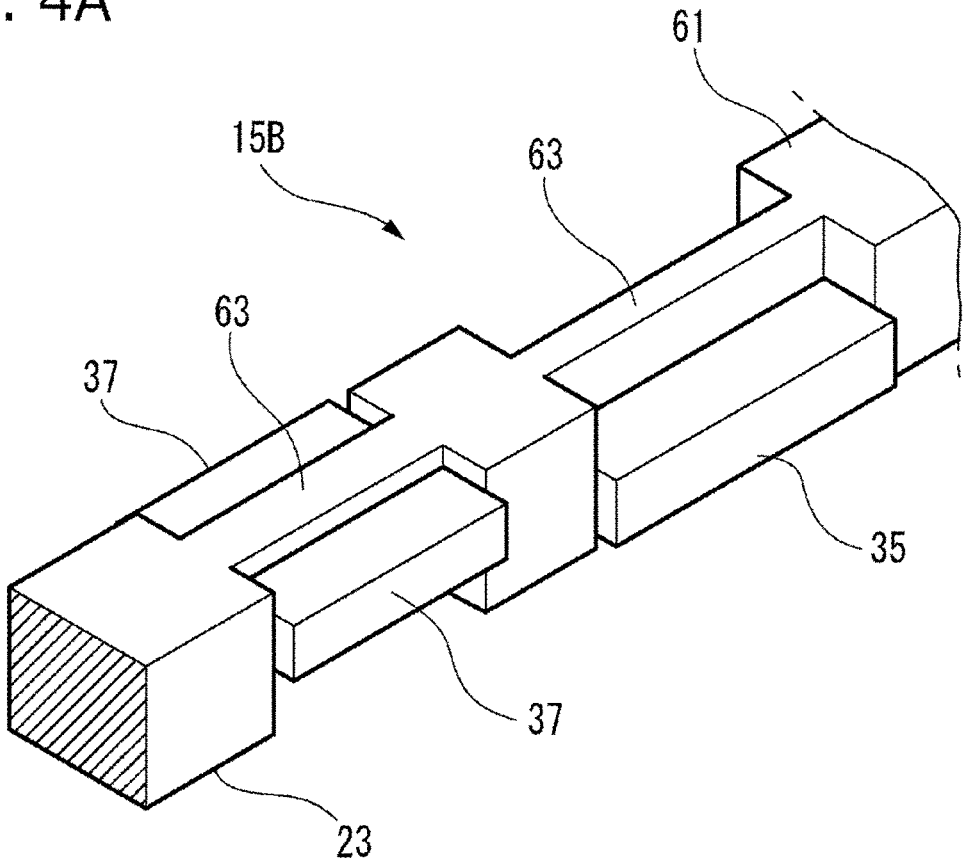
FIG. 4A is an enlarged view of main parts of the pin terminal according to a modification example in which press-fitted sections are provided at different heights and FIG. 4B is a side view of FIG. 4A.
Figure 4B:
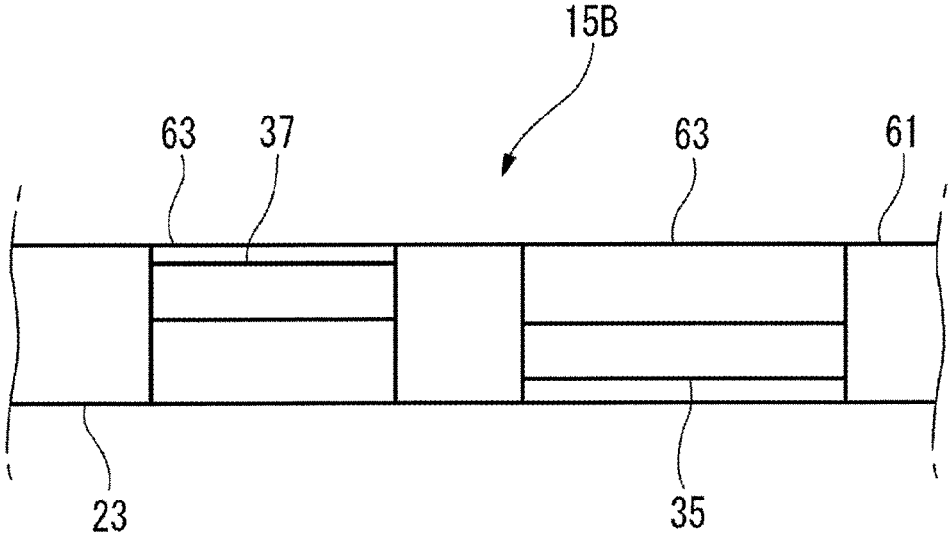

FIG. 4A is an enlarged view of main parts of a pin terminal 15B according to a modification example in which the press-fitted sections 35 and 37 are provided at different heights and FIG. 4B is a side view of FIG. 4A. The pin terminal 15B has a plurality of pairs of press-fitted sections 35 and 37 which are provided at different positions from each other in a height direction (vertical direction in FIG. 4B) orthogonal to the width direction (perpendicular direction to the paper surface in FIG. 4B) of the pin terminal 15. In the example in the drawing, the press-fitted sections 35 are disposed at positions higher than positions of the press-fitted sections 37.

When the pin terminal 15B is inserted into the terminal insertion hole 19 of the connector housing 17, the press-fitted sections 35 and 37 are provided at different positions from each other in the height direction and the press-fitted sections 37 on the front side in the insertion direction are, first, press-fitted. When the press-fitted sections 35 of the pin terminal 15B on the rear side are press-fitted, the press-fitted sections 35 on the rear side are press-fitted at positions different from the positions of the press-fitted sections 37 on the front side in the height direction. Accordingly, press-fitting portions of the terminal insertion hole 19, in which the press-fitted sections 35 of the pin terminal 15B on the rear side are press-fitted, are not worn by the press-fitted sections 37 thereof on the front side. In this manner, the pin terminal 15B has a strong holding force obtained while the press-fitting of the press-fitted sections 37 thereof on the front side does not influence the holding force of the press-fitted sections 35 thereof on the rear side.

In addition, it is preferable that the pin terminal 15 (15A or 15B) is formed of the metal wire on which plating is performed in advance.

In this case, since the metal wire made of an elongated conductive metal material, on which the plating is performed in advance, is cut by the predetermined length such that the pin terminal 15 (15A or 15B) is formed. Therefore, it is possible to achieve an improvement in a yield, compared to a case of using the pin terminal formed through press-working. In addition, a broken surface, on which plating is not performed, is not formed, which can ensure good corrosion resistance and good connection reliability with a counterpart terminal without performing complicated re-plating or chamfering and can ensure high quality.

Moreover, the pin terminal 15 (15A or 15B) made of the metal wire, on which plating is performed in advance, does not have an undercut or a burr, and the plating is evenly performed over the entire circumference. Therefore, in a case where the terminal insertion hole 19 of the connector housing 17 is sealed using a sealing material, it is possible to obtain uniform adhesiveness of the sealing material on the periphery of the pin terminal 15 (15A or 15B), which can ensure good sealability.

Figure 5:
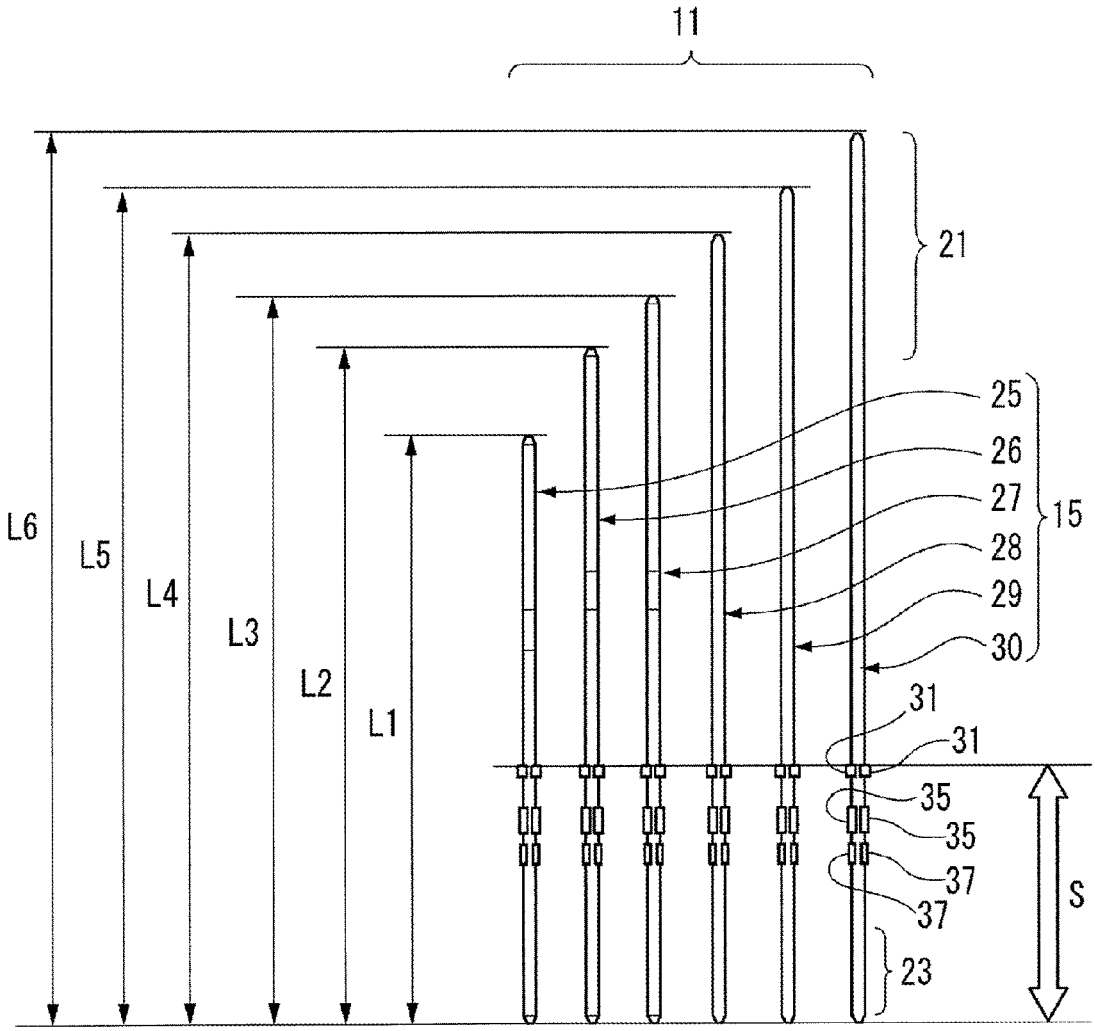
FIG. 5 is a view depicting a terminal inserting position of a terminal group of pin terminals having different lengths, which have the press-fitting supports at the same position thereof.

FIG. 5 is a view depicting a terminal inserting position of a terminal group 11 of pin terminals 15 having different lengths, which have the press-fitting supports 31 and the press-fitted sections 35 and 37 at the same positions.

The pin terminals 25, 26, 27, 28, 29, and 30 having different lengths are set such that an overall length of the pin terminal 25 is L1, an overall length of the pin terminal 26 is L2, an overall length of the pin terminal 27 is L3, an overall length of the pin terminal 28 is L4, an overall length of the pin terminal 29 is L5, an overall length of the pin terminal 30 is L6 ($L1<L2<L3<L4<L5<L6$). When the pin terminals 25, 26, 27, 28, 29, and 30 having different lengths are aligned at the terminal inserting positions (distal end of the terminal), the rear ends of the terminals are shifted. The rear end side of the terminal becomes the board connecting portion 21 described above with respect to the printed circuit board. In addition, the distal end side of the terminal becomes the electrical contact portion 23 described above.

Figure 12:
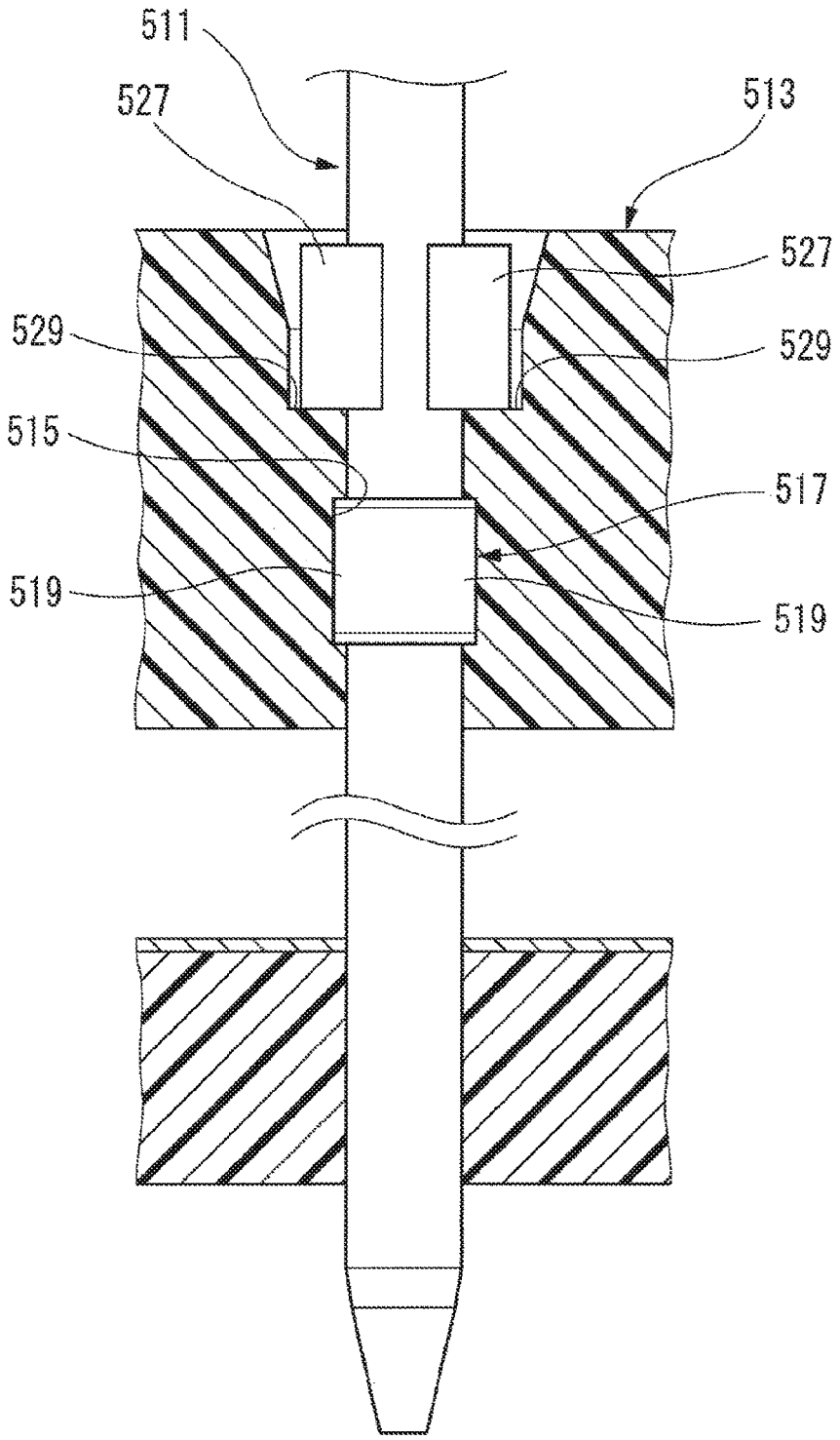
FIG. 12 is an enlarged sectional view of main parts in a state in which a board terminal in the related art is assembled in a board.
Figure 13:
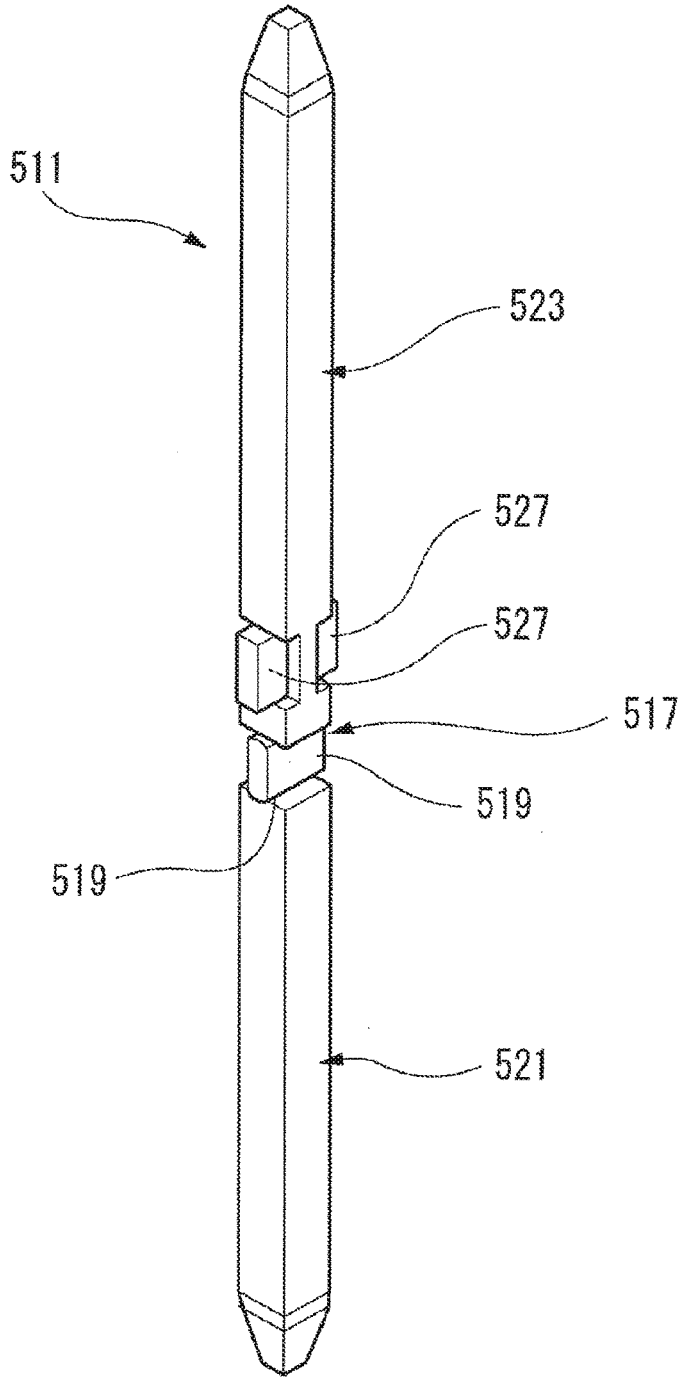
FIG. 13 is a perspective view of the entire board terminal illustrated in FIG. 12.

Incidentally, in a case where the rear end of the terminal is pressed such that the pin terminals are inserted into a terminal holding holes 515 of a terminal holding tool 513 as in a board terminal 511 in the related art illustrated in FIGS. 12 and 13, there is a need to apply insertion strokes according to the board terminals 511 when the board terminals 511 have different lengths. Accordingly, a plurality of insertion heads are needed.

Meanwhile, the pin terminals 25, 26, 27, 28, 29, and 30 having different lengths in the terminal group 11 according to the present embodiment have the press-fitted sections 35 and 37 and the press-fitting support 31 formed at the same distant positions from the distal end of the terminal. Therefore, in a case where the insertion direction rear end side surface 33 of the press-fitting support 31 is pressed and is inserted into the terminal insertion hole 19 of the connector housing 17, the pin terminals 25, 26, 27, 28, 29, and 30 having different lengths can all also be inserted by the same insertion strokes. As a result, the plurality of pin terminals 15 in the terminal group 11 can be inserted by one type of insertion head 39.

In addition, the press-fitted sections 35 and 37 of the pin terminal 15 are set to have the same distance to the rear end side in the insertion direction from the press-fitting support 31. Therefore, the pin terminals 25, 26, 27, 28, 29, and 30 having different lengths can have a press die for forming the press-fitting support 31 and a press die for forming the press-fitted sections 35 and 37 disposed at the same position (of course, the press-fitting support 31 and the press-fitted sections 35 and 37 may be simultaneously formed by one press die). Therefore, in a terminal processing step in which the press-fitting support 31 and the press-fitted sections 35 and 37 are formed, a metal wire may be supplied to the press dies of the press-fitting support 31 and the press-fitted sections 35 and 37 by the supply stroke according to the lengths of various pin terminals 15 and it is easy to control a supply amount of the metal wire which is supplied to the terminal processing step.

As illustrated in FIG. 6, the board connector 13 according to the present embodiment includes the connector housing 17 having the plurality of terminal insertion holes 19 and the terminal group 11 of the plurality of pin terminals 15 described above. The connector housing 17 is made of an insulation synthetic resin material and is formed to have a predetermined shape (for example, substantially a rectangular parallelepiped shape). In the connector housing 17, the plurality of terminal insertion holes 19, which accommodate the pin terminals 15, are formed in the horizontal direction by being arranged in parallel in a row and the terminal insertion holes 19 are arranged vertically in multi-row shape, and thus the multiple terminal insertion holes 19 are arranged in the longitudinal direction and the horizontal direction (refer to FIG. 7). In the present embodiment, for example, an example in which the plurality of rows of pin terminals 15 are arranged in six rows is illustrated, however, the arrangement is not limited thereto.

Next, a terminal press-fitting method of the board connector 13 will be described.

Figure 8A:
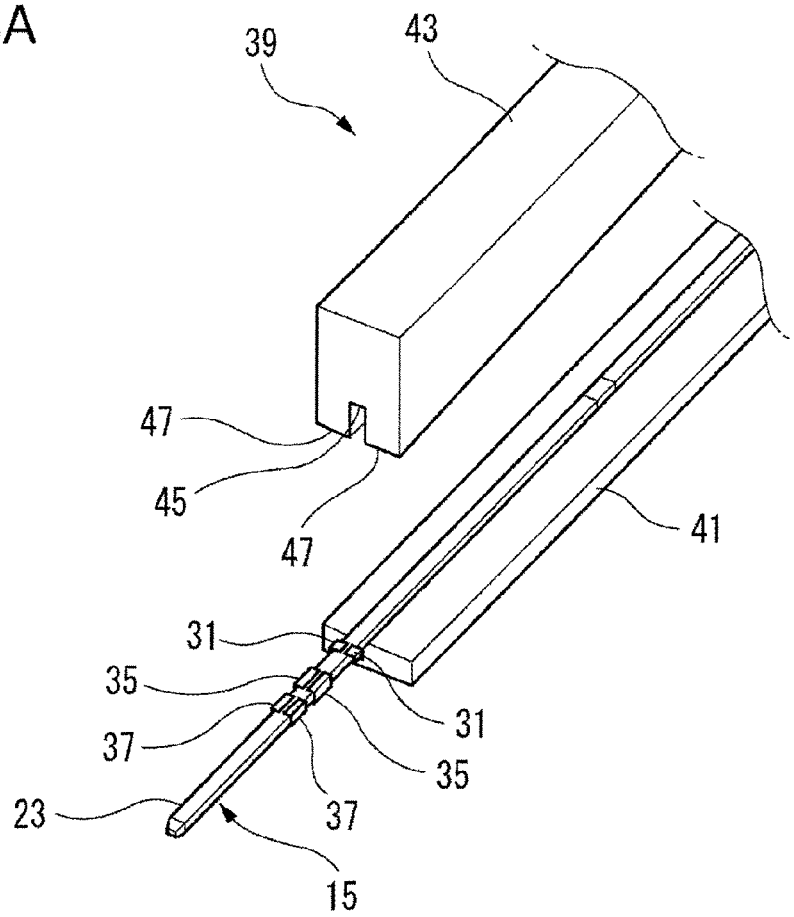
FIG. 8A is a perspective view of the pin terminal before the pin terminal is held by an insertion head and FIG. 8B is a perspective view of the pin terminal held by the insertion head.
Figure 8B:
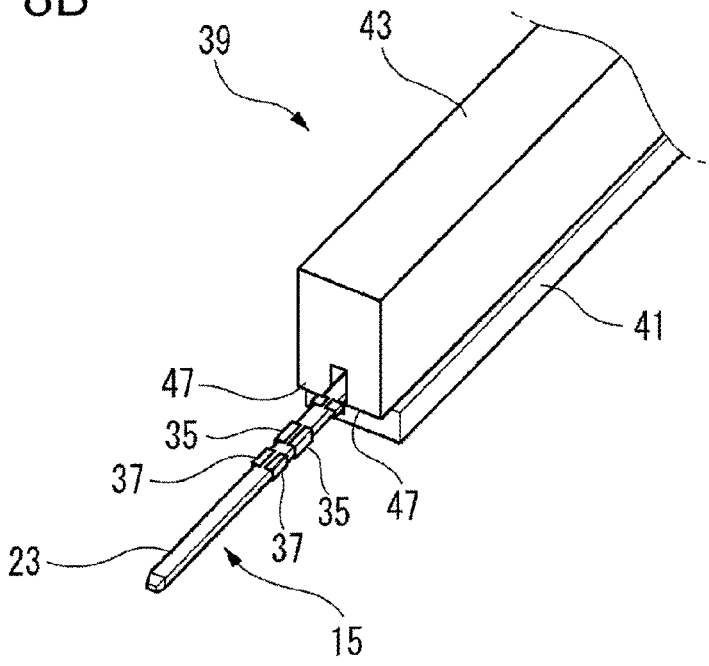

As illustrated in FIGS. 8A and 8B, first, in the assembly of the pin terminal 15 to the connector housing 17, the pin terminal 15 is held by the insertion head 39 (a terminal support 41 and a pinching portion 43).

On the under surface of the pinching portion 43 facing the terminal support 41, an engagement groove 45 engaging with the pin terminal 15 pinched between the terminal support 41 and a pair of locking protrusions 47 which lock the insertion direction rear end side surface 33 of the press-fitting support 31 of the pin terminal 15 and regulate the rearward movement thereof, are provided. In this manner, the insertion head 39 holds the pin terminal 15, the distal end of the pin terminal 15 cut by the predetermined length by the terminal cutting apparatus (not illustrated) in the insertion direction faces the terminal insertion hole 19 of the connector housing 17. The terminal support 41 and the pinching portion 43 lock the insertion direction rear end side surface 33 of the press-fitting support 31, and hold the pin terminal 15 in a state in which the rearward movement is regulated.

A housing moving mechanism in the terminal press-fitting apparatus causes the connector housing 17 to move by a distance of an insertion stroke S such that the pin terminals 15 held in the insertion heads 39 are press-fitted in the corresponding terminal insertion holes 19, respectively.

At this time, the insertion head 39 can lock the press-fitting supports 31 formed at the same position away from the distal end in the insertion direction regardless of the different overall lengths of the pin terminal 15. In this manner, the insertion head 39 can always receive reaction force of the insertion of the pin terminal 15 into the terminal insertion hole 19 of the connector housing 17. Accordingly, the insertion head 39 and the housing moving mechanism can continuously insert the pin terminals 25, 26, 27, 28, 29, and 30 having different lengths into the plurality of terminal insertion holes 19 of the connector housing 17 by the same insertion strokes. It is needless to say that the insertion head 39 is advanced forward by the same stroke with respect to the connector housing 17, and thereby making it possible for the pin terminals 25, 26, 27, 28, 29, and 30 having different lengths can be inserted into the plurality of terminal insertion holes 19, respectively.

In addition, in a case where the elongated metal wire on which plating is performed in advance is used as the elongated metal wires which are cut by the predetermined length in order to form the pin terminals 15 and the press-fitting support 31 is locked to the insertion head 39 such that the pin terminal 15 is inserted into the terminal insertion hole 19 of the connector housing 17. Hence, the insertion head 39 does not come into contact with the board connecting portion 21 of the pin terminal 15 such that the plating on the board connecting portion 21 is prevented from peeling off. Therefore, a soldering deflect according to peeling off of the plating when the board connecting portion 21 of the pin terminal 15 is soldered on the conduction path of the printed circuit board.

Figure 9:
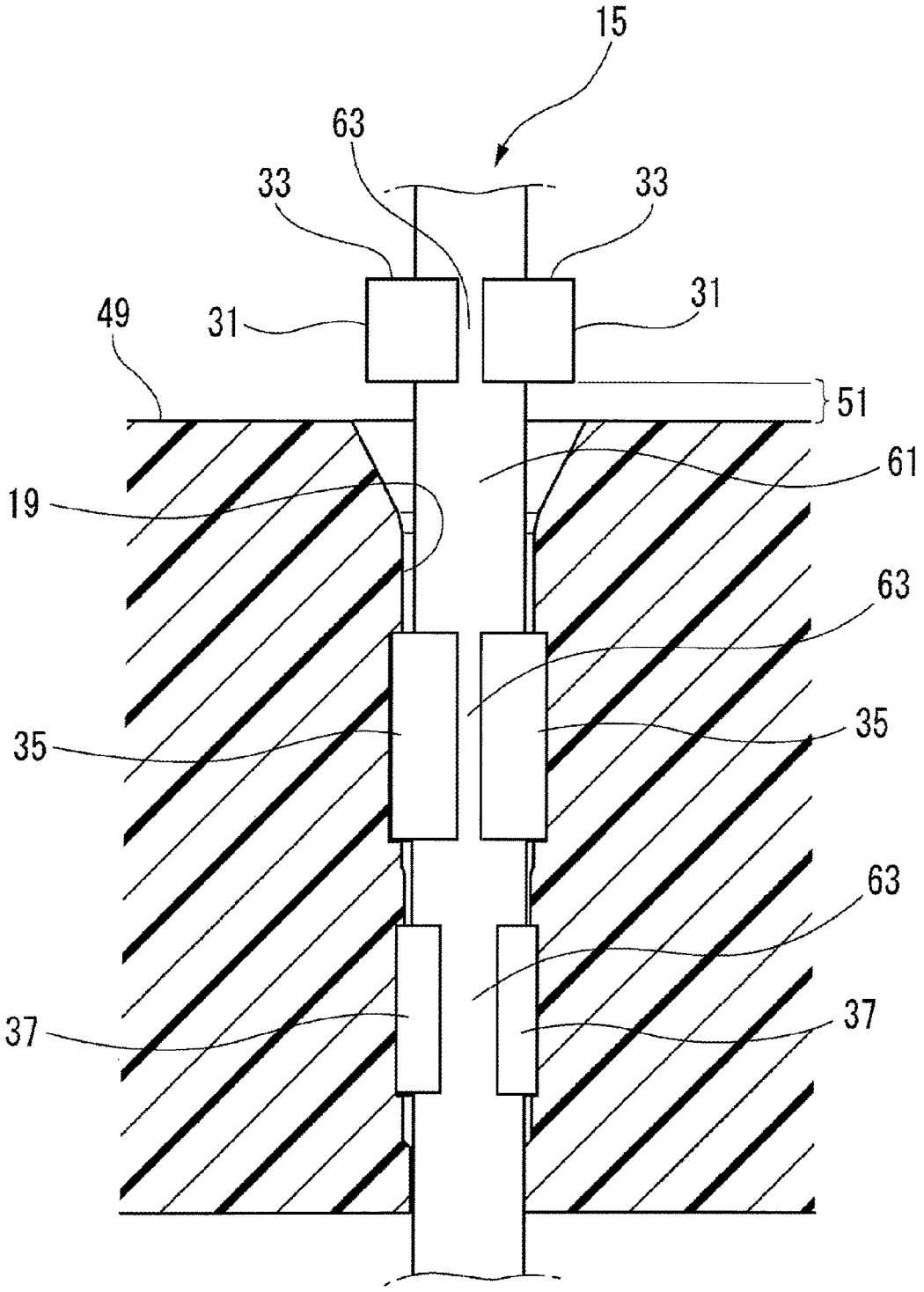
FIG. 9 is a sectional view of main parts of the connector housing after the pin terminal is press-fitted in the terminal insertion hole.

FIG. 9 is a sectional view of main parts of the connector housing 17 after the pin terminal 15 is press-fitted in the terminal insertion hole 19.

In the pin terminal 15 which is completely inserted into the terminal insertion hole 19, the press-fitting support 31 is disposed on the outer side of the terminal insertion hole 19. In other words, a gap is provided between a rear end surface 49 of the housing and the press-fitting support 31. The gap becomes an interference prevention gap 51. Although the press-fitting support 31 is pressed by the insertion head 39 and is deformed, there is no functional problem. Therefore, in the board connector 13, the interference prevention gap 51 is provided between the connector housing 17 and the press-fitting support 31, and thus interference due to contact between the deformed press-fitting support 31 and the connector housing 17 can be prevented. In other words, the insertion position of the pin terminal 15 to the terminal insertion hole 19 is accurately determined by the same insertion stroke S by the housing moving mechanism, without the press-fitting support brought into contact with the connector housing 17. Therefore, without the deformation of the rear end surface 49 of the housing with which the press-fitting support 31 comes into contact, the inserting position of the pin terminal 15 is not shifted.

Figure 10:
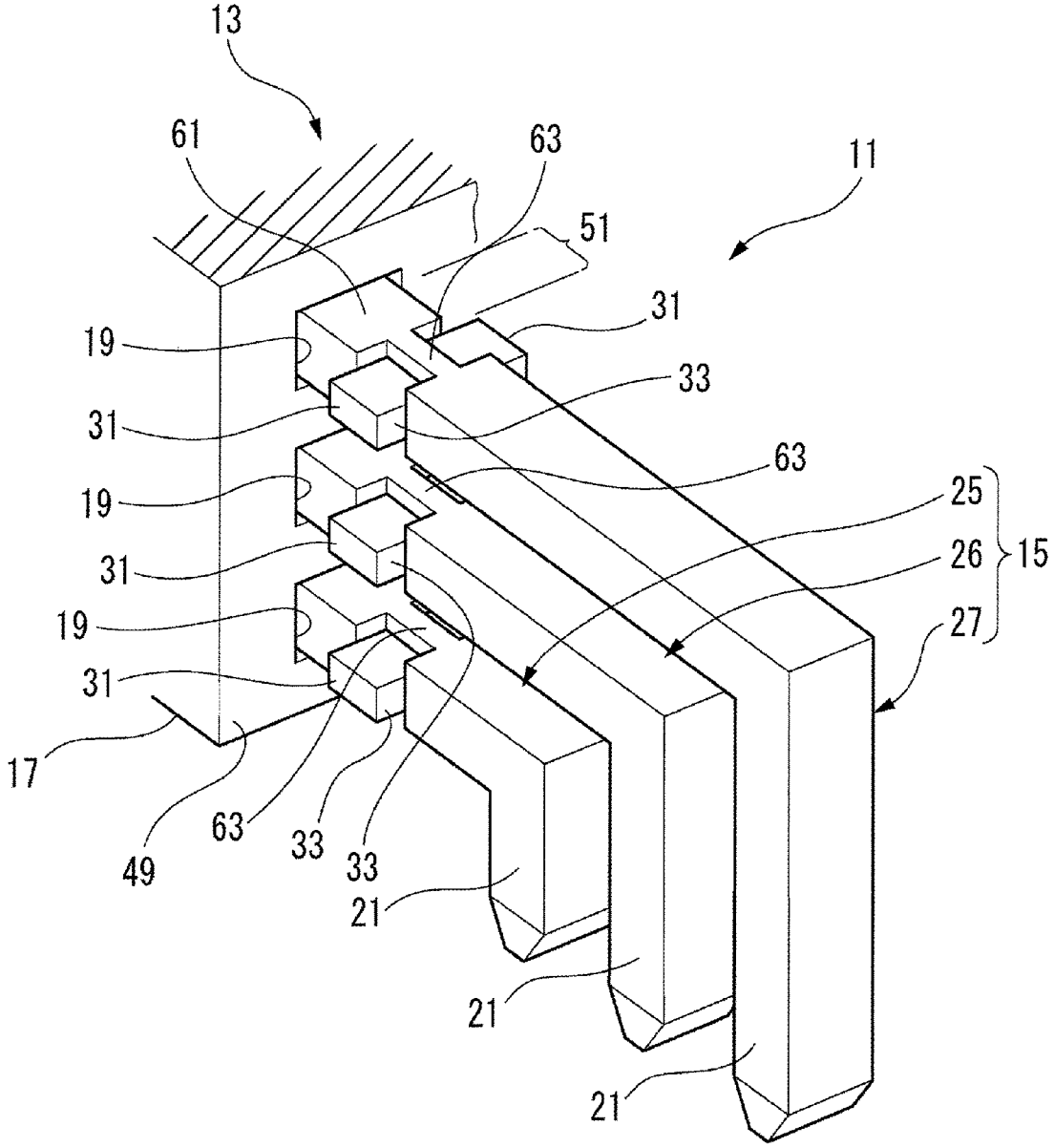
FIG. 10 is a perspective view of main parts illustrating a part of the connector in which the pin terminals are inserted into the terminal insertion holes of the connector housing.
Figure 11:
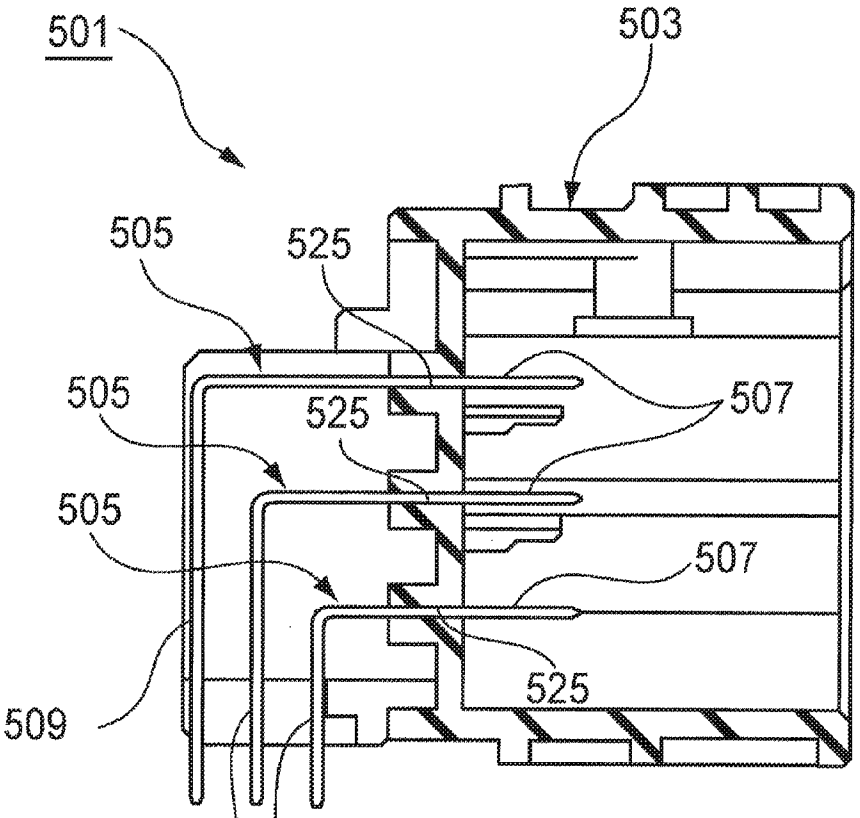
FIG. 11 is a vertical sectional view of a board connector in the related art.

As illustrated in FIG. 10, the pin terminals 25, 26, 27, . . . having different lengths are guided out from the rear end surface 49 of the housing. Each of the board connecting portions 21 is bent at the right angle to the electrical contact portion 23 such that longer terminal of the pin terminals 25, 26, 27, . . . is disposed on the outer side (right side in FIG. 10). The bent board connecting portion 21 is disposed perpendicularly to the printed circuit board (not illustrated). At this time, the press-fitting support 31 is exposed at a portion of the board connector 13, immediately after the pin terminal is guided out from the terminal insertion hole 19. The interference prevention gap 51 described above is secured between the exposed press-fitting support 31 and the rear end surface 49 of the housing.

Next, operations of the configurations described above will be described.

In the terminal group 11 according to the present embodiment, when the plurality of pin terminals 15 of the terminal group 11 are press-fitted in the plurality of terminal insertion holes 19 of the connector housing 17, respectively, the insertion direction rear end side surfaces 33 of the press-fitting supports 31, which are formed at the same position from the distal ends of the pin terminals in the insertion direction regardless of the different overall lengths of the plurality of pin terminals 15, are supported by an insertion jig of the insertion head 39 or the like, and thus, it is possible to always receive reaction force of the press-fitting of the pin terminals 15 which are press-fitted in the terminal insertion holes 19 of the connector housing 17. Therefore, the pin terminals 25, 26, 27, 28, 29, and 30 having different lengths can be continuously inserted into the plurality of terminal insertion holes 19 of the connector housing 17, with the same stroke.

Since each of the pin terminals 15 of the terminal group 11 according to the present embodiment has the two pairs of press-fitted sections 35 and 37 protruding from both the side edges of the pin terminal in the width direction and the press-fitted sections are press-fitted and held in the terminal insertion hole 19, it is easy to achieve high press-fitting accuracy and strong press-fitting and holding force, compared to a case where a pin terminal 15 is inserted into a terminal insertion hole 19 without the press-fitted sections.

In addition, two pairs of press-fitted sections 35 and 37 are formed to have protruding heights which are lowered, respectively, as close to the distal end of the pin terminal 15 in the insertion direction. A press-contact force with respect to the terminal insertion hole 19 is increased in a stepwise manner as deep in an insertion depth of the distal end of the pin terminal 15 in the insertion direction, which is inserted into the terminal insertion hole 19, and the press-fitted sections are press-fitted while inner surfaces of the terminal insertion hole 19 are gradually deformed by the two pairs of press-fitted sections 35 and 37. Therefore, it is possible to reduce press-fitting resistance. It is needless to say that as the pin terminal of the terminal group 11 according to the present invention, a pin terminal in which only the press-fitting support 31 is provided without the press-fitted sections 35 and 37 can be press-fitted in the terminal insertion hole 19.

In the board connector 13 according to the present embodiment, when the plurality of pin terminals 15 of the terminal group 11 are press-fitted in the plurality of terminal insertion holes 19 of the connector housing 17, respectively, the insertion direction rear end side surfaces 33 of the press-fitting supports 31, which are formed at the same distant position from the distal ends of the pin terminals in the insertion direction regardless of the different overall lengths of the plurality of pin terminals 15, are supported by the insertion head 39 of the terminal press-fitting apparatus, and thus, it is possible to always receive reaction force of the press-fitting of the pin terminals 15 which are press-fitted in the terminal insertion holes 19 of the connector housing 17. Therefore, the pin terminals 25, 26, 27, 28, 29, and 30 having different lengths can be continuously inserted into the plurality of terminal insertion holes 19 of the connector housing 17, with the same insertion strokes.

Accordingly, with the terminal group 11 and the board connector 13 according to the present embodiment, a terminal press-fitting apparatus can be miniaturized and manufacturing costs of the board connector 13 can be reduced such that the board connector 13 can be provided at a low cost.

Here, characteristics of the embodiments of the pin terminal, the terminal group, and the connector are collectively and briefly listed as follows.

[1] There is provided a terminal group (11) including: a plurality of pin terminals (15) which are formed by cutting an elongated metal wire by a predetermined length and are to be press-fitted and held in each of a plurality of terminal insertion holes (19) of a connector housing (17). The plurality of pin terminals (15), which include the pin terminals (pin terminals 25, 26, 27, 28, 29, and 30) having different overall lengths, have a pair of press-fitting supports (31) that protrude from both side edges of the pin terminal (15) in a width direction thereof, respectively, at the same positions away from the rear end in an insertion direction, and insertion direction rear end side surface (33) of the press-fitting support (31) receive reaction force with respect to the terminal insertion holes (19) in press-fitting.

[2] In the terminal group (11) according to [1], a pair of press-fitted sections (35) may be formed on the front end side of the pin terminal (15) than the press-fitting support (31) in the insertion direction so as to protrude from both side edges of the pin terminal (15) in the width direction and the press-fitted sections (35) may be press-fitted and held in the terminal insertion hole (19).

[3] In the terminal group (11) according to [2], a plurality of pairs of press-fitted sections (35 and 37) are formed on the pin terminal (15) in the insertion direction and the plurality of pairs of press-fitted sections (35 and 37) are formed to have protruding heights which are lowered, respectively, as close to a distal end of the pin terminal (15) in the insertion direction.

[4] In the terminal group (11) according to [2] or [3], a non-plastic forming-processed surface (63) where plastic forming is not performed on a terminal surface (61) of the pin terminal (15, 15A, or 15B) in at least one of a region or a part of the region between the pair of press-fitting supports (31) and a region or a part of the region between the pair of press-fitted sections (35).

[5] In the terminal group (11) according to [4], the non-plastic forming-processed surface (63) is connected to the terminal surface (61) by a tapered flat surface (65) having a width which is gradually widened.

[6] In the terminal group (11) according to any one of [2] to [5], the pin terminal (15B) has a plurality of pairs of press-fitted sections (35 and 37) which are formed at intervals in the insertion direction. The plurality of pairs of press-fitted sections (35 and 37) are provided at different positions from each other in a height direction orthogonal to the width direction of the pin terminal (15B).

[7] In the terminal group (11) according to any one of [1] to [6], the pin terminal (15, 15A, or 15B) is formed of the metal wire on which plating is performed in advance.

[8] There is provided a connector (board connector 13) including: a connector housing (17) having a plurality of terminal insertion holes (19); and a terminal group (11) of a plurality of pin terminals (15) which are press-fitted and held in the plurality of terminal insertion holes (19), respectively. The plurality of pin terminals (15), which include the pin terminals (pin terminals 25, 26, 27, 28, 29, and 30) having different overall lengths, have a pair of press-fitting supports (31) that protrude from both side edges of the pin terminal (15) in a width direction thereof, respectively, at the same position away from the rear end in an insertion direction and that receive reaction force with respect to the terminal insertion holes (19) in press-fitting.

Further, the present invention is not limited to the embodiments described above, but can be appropriately modified, improved, or the like. Besides, a material of, a shape of, a dimension of, the number of, a disposed position of, or the like of the respective components in the embodiment described above is not limited thereto, but is arbitrary, as long as the present invention is achieved.

What is claimed is:

1. A terminal group comprising:

a plurality of pin terminals, each pin terminal being formed of a metal wire of a predetermined length and being configured to be press-fitted and held in each of a plurality of terminal insertion holes of a connector housing, wherein some of the plurality of pin terminals have different overall lengths, the plurality of pin terminals respectively have a pair of press-fitting supports that protrude from both side edges of each of the plurality of pin terminals in a width direction at the same distant positions from a distal end in an insertion direction, and insertion direction rear end side surfaces of the press-fitting supports receive a reaction force of an insertion tool with respect to the terminal insertion holes in press-fitting to urge the pin terminals into the terminal insertion holes.

2. The terminal group according to claim 1, wherein at least a pair of press-fitted sections are formed closer to a front end side of the insertion direction of the pin terminal than the press-fitting supports, and wherein the press-fitted sections protrude from both side edges of the pin terminal in the width direction thereof, and the pair of press-fitted sections are configured to be press-fitted and held in the terminal insertion hole.

3. The terminal group according to claim 2, wherein a non-plastic forming-processed surface where plastic forming is not performed on a terminal surface of the pin terminal is provided, in at least one of a region or a part of the region between the pair of the press-fitting supports and a region or a part of the region between the pair of press-fitted sections.

4. The terminal group according to claim 3, wherein the non-plastic forming-processed surface is connected to the terminal surface by a tapered flat surface having a width which is gradually widened.

5. The terminal group according to claim 2, wherein the pin terminal has a plurality of the pairs of press-fitted sections which are formed at intervals in the insertion direction, and the plurality of the pairs of press-fitted sections are provided at different positions from each other in a height direction orthogonal to the width direction of the pin terminal.

6. The terminal group according to claim 1, wherein the metal wire from which the pin terminal is formed is plated.

7. A device comprising:

the connector housing, a connector housing, a plurality of pin terminals, each pin terminal being formed of a metal wire of a predetermined length and being configured to be press-fitted and held in each of a plurality of terminal insertion holes of the connector housing, wherein some of the plurality of pin terminals have different overall lengths, the plurality of pin terminals respectively have a pair of press-fitting supports that same distant positions from a distal end in an insertion direction, and insertion direction rear end side surfaces of the press-fitting supports receive a reaction force of an insertion tool with respect to the terminal insertion holes in press-fitting to urge the pin terminals into the terminal insertion holes of the connector housing.

8. The terminal group according to claim 1, wherein the pair of press-fitting supports are located outside of the connector housing when the plurality of pin terminals are held in the plurality of terminal insertion holes of the connector housing.

* * * * *